US005832937A

United States Patent [19]

Fujikawa

[11] Patent Number: 5,832,937

[45] Date of Patent: Nov. 10, 1998

[54] HAIRCUT METHOD

[75] Inventor: Hiroshi Fujikawa, Kadoma, Japan

[73] Assignee: Kabushiki Kaisha Facky-Mos Asahi, Osaka, Japan

[21] Appl. No.: 840,184

[22] Filed: Apr. 11, 1997

[30] Foreign Application Priority Data

Jun. 28, 1996 [JP] Japan ..... 8-169741

[51] Int. Cl.[6] ..... A45D 24/00

[52] U.S. Cl. ..... 132/200; 132/213

[58] Field of Search ..... 132/200, 213, 132/213.1, 214

[56] References Cited

U.S. PATENT DOCUMENTS

| | | | |
|---|---|---|---|
| 2,558,516 | 6/1951 | Granbberg | 132/213 |
| 2,581,704 | 1/1952 | Reno | 132/200 |
| 2,722,223 | 11/1955 | Fox, Sr. | 132/213 |
| 2,919,702 | 1/1960 | Olivo | 132/200 |
| 4,317,462 | 3/1982 | Steiner | 132/213 |
| 4,414,991 | 11/1983 | Marcotte | 132/214 |
| 4,867,184 | 9/1989 | Davis | 132/214 |
| 5,427,122 | 6/1995 | Hamilton | 132/214 |

FOREIGN PATENT DOCUMENTS

| | | | |
|---|---|---|---|
| 2666207 | 3/1992 | France | 132/214 |

*Primary Examiner*—Todd E. Manahan
*Attorney, Agent, or Firm*—Merchant, Gould, Smith, Edell, Welter & Schmidt

[57] ABSTRACT

A method for cutting hair which realizes a hairstyle to give a light appearance of movability and vividness by giving natural irregularities to length of the hair. Three different reference lengths are used for one hairstyle. A founding portion of hair is cut by using a shortest reference length, hair of a vector portion is cut by using a middle reference length, and hair of an outer portion that forms an appearance of the hairstyle is cut by using a longest reference length.

2 Claims, 24 Drawing Sheets

HAIRCUT METHOD

BACKGROUND OF THE INVENTION

1. Field of the Invention

The present invention relates to a haircut method used in a hairdressing and cosmetic field.

2. Description of the Related Arts

In a hairdressing and cosmetic field, the haircut theories that have been used hitherto are typified by Vidal Sassoon's theory, which has been widely practiced all over the world. This theory is a theory to trim up the whole hair in such a fashion that the hair is given a certain regularity in length based on one particular guide (which is a length initially determined as a reference length for the hair cutting). The Vidal Sassoon's theory has a basic concept that the whole hairstyle thus finished is characterized by "trimming," "setting," and/or "coordinating" the hair in good order.

The aforementioned regularity thereof is given by three patterns that are so-called "gradation", "one length", and "layer".

That is, the "gradation" is a pattern for trimming up the hair in such a way that the hair length increases continuously from bottom to top with the hair on a side of its skirt or bottom being taken as the guide. The "one length" is a pattern for trimming up the whole hair with the same guide length. The "layer" is a pattern for trimming up the hair in such a way that the hair length increases continuously from top to bottom with the hair on a top side of the head being taken as the guide, conversely to the "gradation".

In accordance with the Vidal Sassoon's theory, the whole hairstyle is finished up on a basis of one of the three patterns so that the hair tips are trimmed up so as to form a continuous straight line or curved line.

The whole hairstyle formed in accordance with aforementioned three basic concepts of the "trimming," "setting," and/or "coadinating" is rather given an impression of "immovability" or "fixiation" of the hair style. The basic concepts are construed in a sense that the fluidity (or flowing property) and movability inherent in the hair itself are suppressed. In other words, such properties of the hair are regarded as functioning as a factor that causes the hairstyle a "disturbance", for example, when the hair is agitated by the wind or when the hair is waved at time of playing sport games.

An immovable hairstyle, however, looks unnatural, and some clients do not like such an immovable or fixed hairstyle. Thus, to solve the problem of unnatural appearance in the hairstyle has been an important issue and theme for both clients and hairdressers.

Although many attempts have been made by individual hairdressers toward overcoming the above problem, those attempts have never been systematized theoretically, nor have gone beyond experiments.

SUMMARY OF THE INVENTION

Therefore, it is an object of the present invention to provide a novel haircut method which solves the above problem and by which a beautiful hairstyle with maximum fluidity or movability, and vividness, thereof is realized.

In accomplishing this and other objects of the present invention, there is provided a haircut method which has the following characteristics in order to solve the aforementioned problem of the prior art and to achieve its objects.

That is, the haircut method comprises a step of cutting hair on a basis of a plurality of different reference lengths or guides.

According to the haircut method, the finished hairstyle has no such portions as the cutting is done by one reference length or guide length, and the hairstyle is finished with any part thereof being so formed that hairs cut by a plurality of cutting ways are mixed up therein on the whole. In this way, by intentionally failing to trim up the hair into a uniform length, the image of immovable or fixed hairstyle, and the image of unnaturalness thereof are dissipated.

With the haircut method, the hairstyle is finished with a natural appearance full of fluidity or movability, and vividness.

According to the present invention, there is also provided a haircut method comprising: a first step for cutting hair on a first partial zone of one's head on a basis of a first reference length which is shortest; a second step for cutting hair on a second partial zone of the head on a basis of a second reference length which is longer than the first reference length; and a third step for cutting hair on a whole zone of the head on a basis of a third reference length which is longer than the second reference length.

The first step is a step in which a cut for forming a foundation part of hair that serves as a base for the final hairstyle is carried out. The hairs cut in the second and third steps mentioned below overlap on the foundation part thereof thus cut in the first step. Since the hair cut and left in the first step is the shortest, the hair of the foundation part rises or stands up so as to lift the hair overlaid thereon (i.e. the hair formed in the second and third steps), giving a feel or appearance of volume to the whole hairstyle.

The second step is a step in which a cut that gives a strength and a weakness, directivity and variations to the motion of the whole hair is carried out. The hair cut in this step gives various characteristics in motion of the whole hair, depending on the direction in which the hair is grown or on the nature of the hair. Therefore, the hair cut and left in this step predetermines a motion of the hair which is cut and left in the next third step and overlaid thereon. The second zone where the second step is done may be partly coincident with the first zone where the first step is done.

The third step is a step in which a cut that gives a motion of the hair that is actually exposed outside as a hairstyle is carried out. The hair cut and left in this step is light and voluminous with being overlaid on the hair cut and left in the first and second steps, so that the natural movability and vividness of the hair is realized when the hair is waved or fluttered by a wind or moved in accompaniment to a motion of the body.

Further, in the haircut method according to the present invention, it is preferable that the amount or quantity of hair is adjusted in each step so that the quantity thereof is reduced stepwise more in the second step than in the first step, and more in the third step than in the second step. As a result of adjusting the quantity of hair, the hair cut and left in the second step and the hair cut and left in the third step become lighter and easier to move so that the appearance of fluidity or movability, and the appearance of vividness are emphasized.

Also, since the hair cut and left in the first step keeps in a sufficient quantity, a look or appearance of voluminosity is realized even if the hair formed by the first step is lightly covered with the hair overlaid thereon. As a whole, the hair becomes lighter while keeping voluminous, exhibiting lightly flowing and vivid impressions as expressions of the hair.

Depending on what regions to be cut of the head are selected in each of the above three steps, a countless variety of hairstyles can be created.

If the cut regions and cut patterns in the individual steps are predetermined and recorded, a particular hairstyle can be reproduced anytime based on the records.

BRIEF DESCRIPTION OF THE DRAWINGS

This and other objects and features of the present invention will become clear from the following description taken in conjection with the preferred embodiments thereof with reference to the accompanying drawings, in which.

DETAILED DESCRIPTION OF THE PREFERRED EMBODIMENTS

Figure 1:
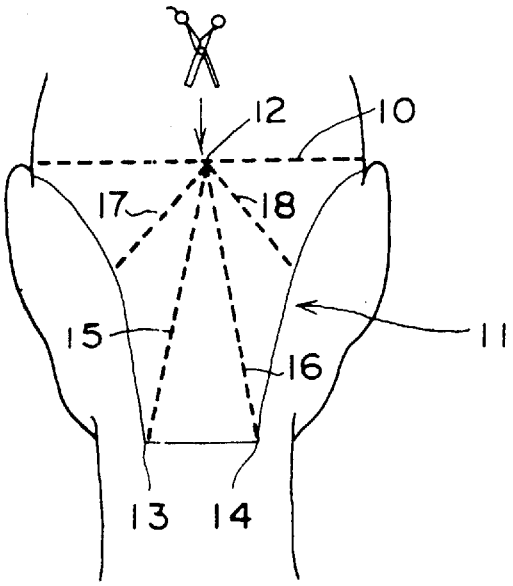
FIG. 1 is an explanatory view showing patterns of founding and vector portions of hair of a first block in a first embodiment of a haircut method according to the present invention.

Before the description of the present invention proceeds, it is to be noted that like or corresponding parts are designated by like reference numerals throughout the accompanying drawings.

Hereinafter, a first step will be referred to as a "founding", a second step as a "vector", and a third step as an "outer".

A cutting for a long hairstyle is first explained with reference to FIGS. 1 through 29, as a first embodiment. FIG. 1 shows that a back part of a person's head below a line 10 connecting upper ends of a pair of ears with each other is a first block 11. The figure is shown as a figure being viewed from the back part of the head. In the figure, a pair of lines 15 and 16 extending from an upper-end center 12 of the block 11 toward both nape corners 13 and 14 of the hair define a zone in which the hair is cut as the founding portion, while a pair of lines 17 and 18 extending from the upper-end center 12 of the block 11 toward the lower ends of the two ears define a zone in which the hair is be cut as the vector portion.

Figure 2:
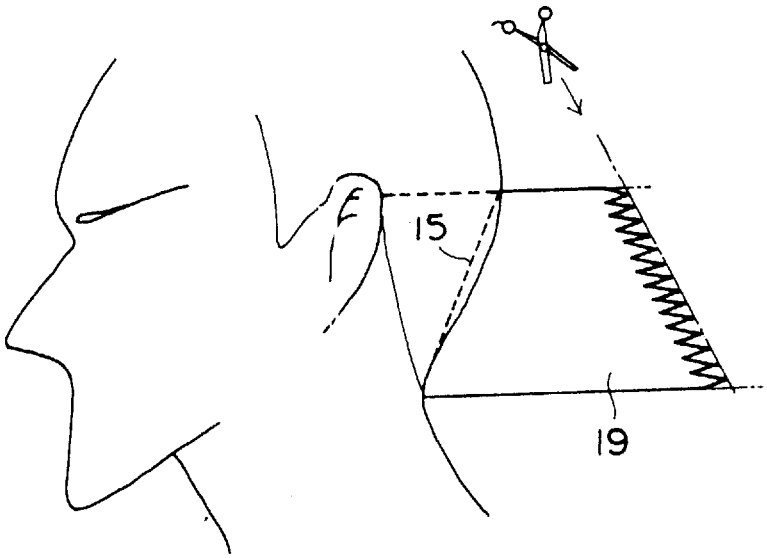
FIG. 2 is an explanatory view showing how to cut the founding portion of the first block in the first embodiment of the haircut method according to the invention.

The founding portions 15 and 16 are cut, as shown in FIG. 2, by taking a slice of hair, or a panel of hair, or a hair bundle 19 at the corresponding zone so that the length of hair increases along a direction from the top end side of the first block 11 toward the bottom or skirt thereof. The hair at the founding portion 15 and 16 is cut so that a ratio of its length to a length of a guide for the outer, described later, is 5–7:10 if the length of the guide for the outer is taken as 10.

Figure 3:
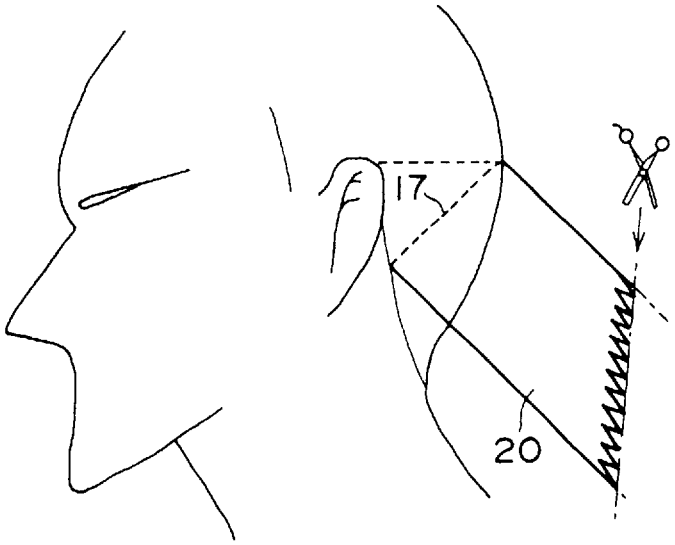
FIG. 3 is an explanatory view showing how to cut the vector portion of the first block in the first embodiment of the haircut method according to the invention.

The vector portions 17 and 18 are cut, as shown in FIG. 3, by taking a slice of hair or a hair bundle 20 at the corresponding zone so that the length of hair also increases along the direction from the top end side of the block 11 toward the bottom or skirt thereof. The hair at the vector portions 17 and 18 is cut so that a ratio of its length to the length of the guide for the outer is 7–8:10 if the length of the guide for the outer is taken as 10.

Figure 4:
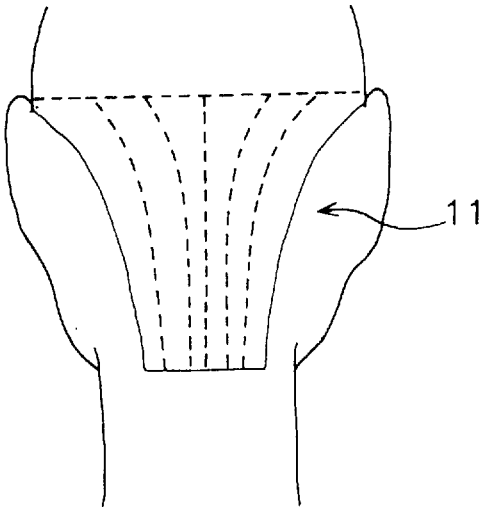
FIG. 4 is an explanatory view showing a pattern as to how to take hair bundles for cutting of an outer portion of hair of the first block in the first embodiment of the haircut method according to the invention.
Figure 5:
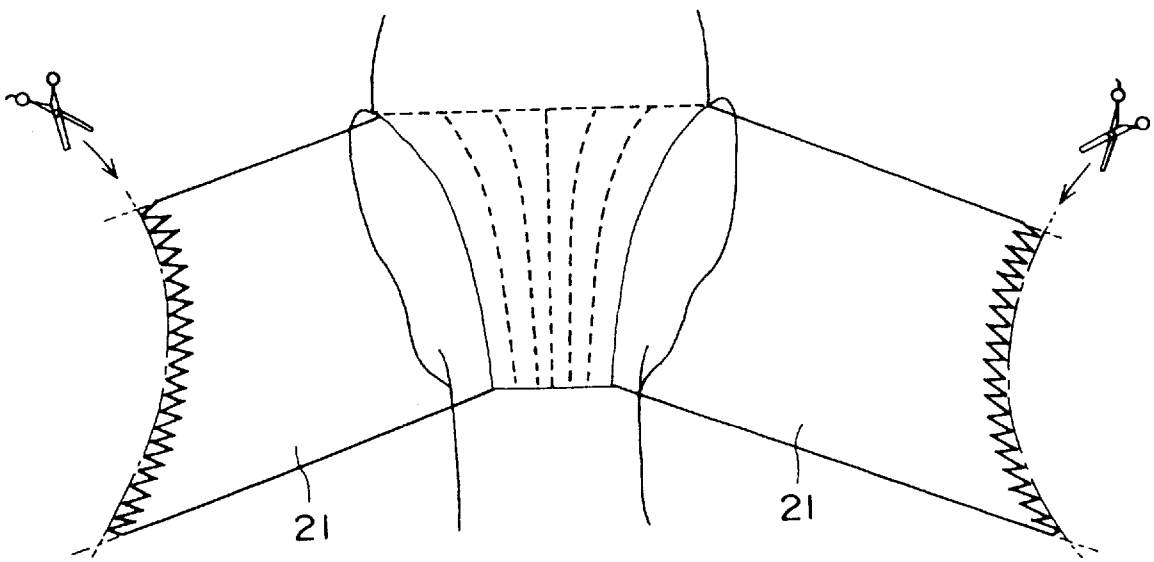
FIG. 5 is an explanatory view showing how to cut the outer portion of the first block in the first embodiment of the haircut method according to the invention.

The outer portion of hair is cut through the steps of dividing the whole first block 11 into three longitudinal slices for each of right and left halves as shown in FIG. 4, and cutting a hair bundle 21 of each slice so that the length of hair increases toward the nape, or bottom, uniformly for all the slices as shown in the FIG. 5. The cutting is carried out in an order starting with the inner-side slice toward the outer-side slices on both sides. Each slice is cut from top down, as shown in the figure. The guide for the outer is determined depending on the length for the long-hair coiffure that the client desires.

Figure 6:
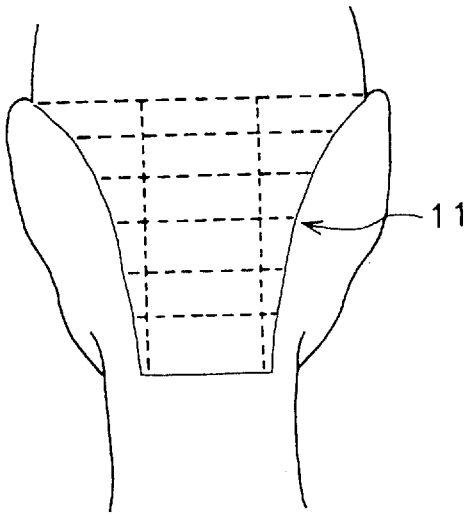
FIG. 6 is an explanatory view showing a pattern as to how to take hair bundles for a check cut of the first block in the first embodiment of the haircut method according to the invention.
Figure 7:
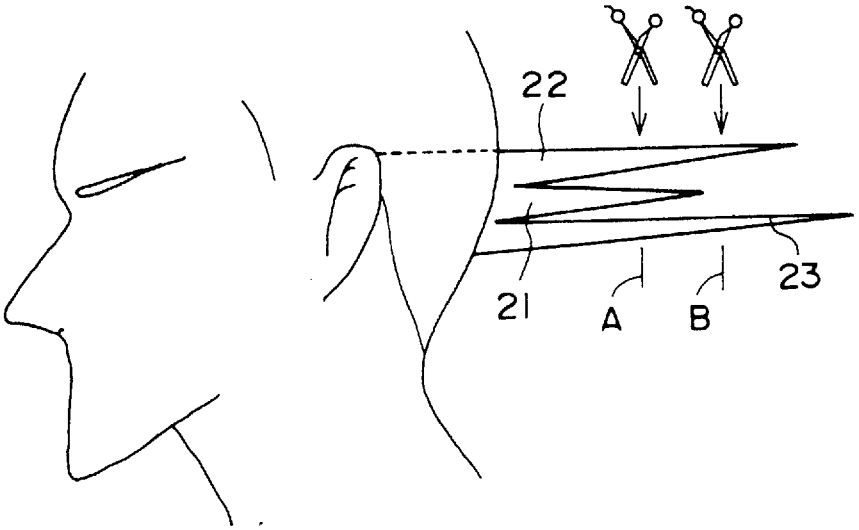
FIG. 7 is an explanatory view showing how to make the check cut of the first block in the first embodiment of the haircut method according to the invention.
Figure 8:
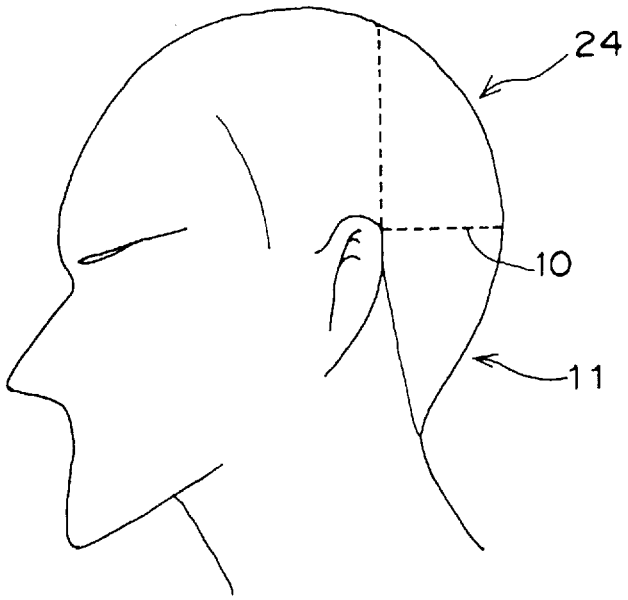
FIG. 8 is an explanatory view showing a second block in the first embodiment of the haircut method according to the invention.

The finishing of the first block 11 is achieved by a check cut with the purpose of arranging or adjusting a qualitative feel for the whole hairstyle. This check cut is carried out through the steps of, as shown in FIG. 6, dividing the whole block 11 into longitudinal three sub-blocks (i.e. a left longitudinal sub-block, a central longitudinal sub-block, and a right longitudinal sub-block), and taking and cutting horizontal slices from top down for each of the three blocks. Each slice has the founding hair 21, the vector hair 22 and the outer hair 23 mixed together therein as shown in FIG. 7.

In the check cut, a tapering cut is done over a range from A to B, as shown in the figure, for each slice. This tapering cut is a cut that reduces the quantity or amount of hair by making the hair irregular in length with a natural feeling. The tapering cut is carried out not by uniformly trimming up the hair tips. The tapering cut can be easily achieved by using moving-cut scissors (Tapering No. 1 T33i, Tapering No. 2 T33s, Tapering No. 3, etc.) which are available from Kabushiki Kaisha Facky-Mos Asahi, the present applicant. Otherwise, it is also possible to finish coiffing a similar hairstyle by using a combination of conventional thinning scissors and cutting scissors over two or more steps taken.

By the way, the scissors shown throughout the drawings represent the aforementioned moving-cut scissors. The moving-cut scissors have one blade (i.e. one counterpart thereof) which is formed like a comb; however, the moving-cut scissors are depicted like ordinary scissors for simplicity in the drawings. The range from A to B in the figure shows a range which corresponds to hair-tip portions of the founding hair 21 and the vector hair 22, and which does not include the hair-tip portion of the outer hair 23.

By making the check cut in this way, the founding hair 21, the vector hair 22, and the outer hair 23 are adjusted with respect to the quantity of hair, respectively, while their hair tips are made irregular, for the hairstyle as a whole. As for the quantity of hair, the founding hair is scarcely reduced. On the other hand, the vector hair is reduced to about 90% while the outer hair is reduced to about 70%, with respect to the founding hair.

Next, a procedure of cutting hair in a second block 24 (shown in FIG. 8) above the first block 11 is explained below.

Figure 9:
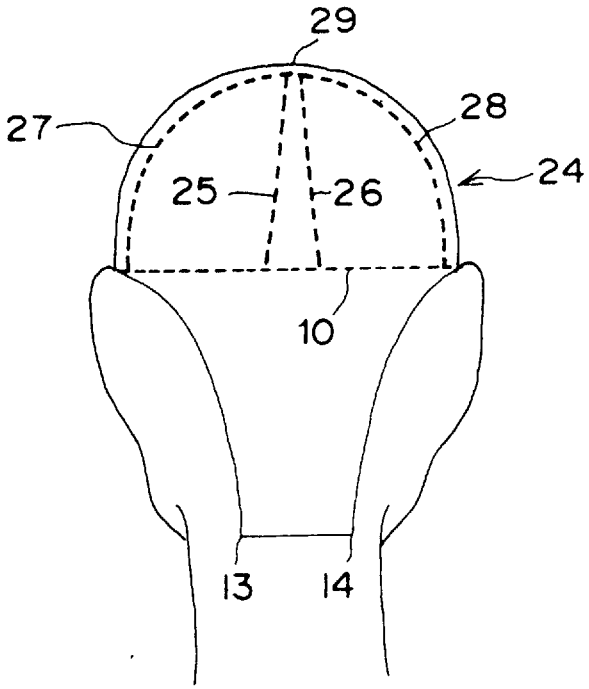
FIG. 9 is an explanatory view showing patterns of founding and vector portions of hair of the second block in the first embodiment of the haircut method according to the invention.

The second block 24 is a block of the back part of the head above the line 10 connecting the upper ends of the two ears with each other, when viewed from the rear of the head as shown in FIG. 9, where hair cutting zones as founding portions 25 and 26, and vector portions 27 and 28 are set as shown in the figure.

The founding portions 25 and 26 are defined by lines extending from a top 29 of the second block 24 toward both nape corners 13 and 14. The vector portions 27 and 28 are defined by a circular curve passing through the top 29 of the second block 24 and connecting the upper ends of the two ears with each other. The top 29 itself is regarded as included in the founding portion.

Figure 10:
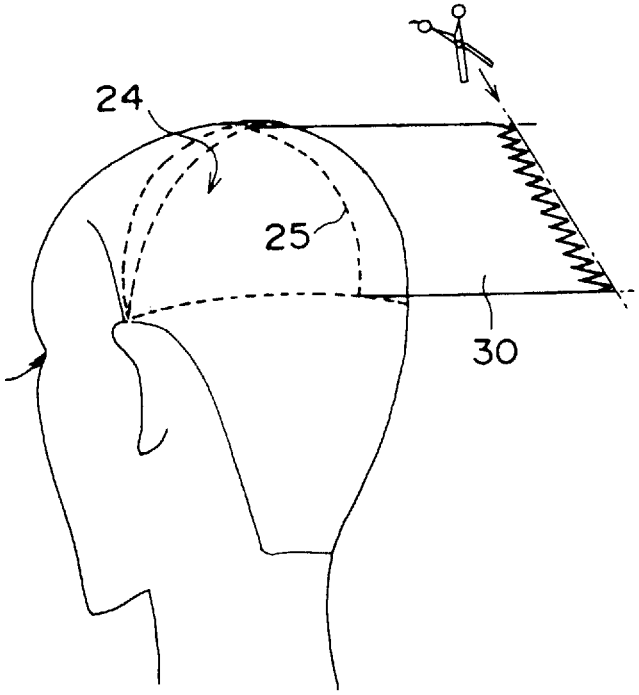
FIG. 10 is an explanatory view showing how to cut the founding portion of the second block in the first embodiment of the haircut method according to the invention.

The cutting of the founding portions 25 and 26 is carried out, as shown in FIG. 10, first by taking a hair bundle 30 in a slicing or combing way out of the corresponding zone, and then by cutting the hair bundle 30 from top down in the second block 24 so that the hair remains approximately uniform in length. For this founding portion 25 and 26, the hair is cut so that its length falls within a range of 50–70% of the guide for the outer.

Figure 11:
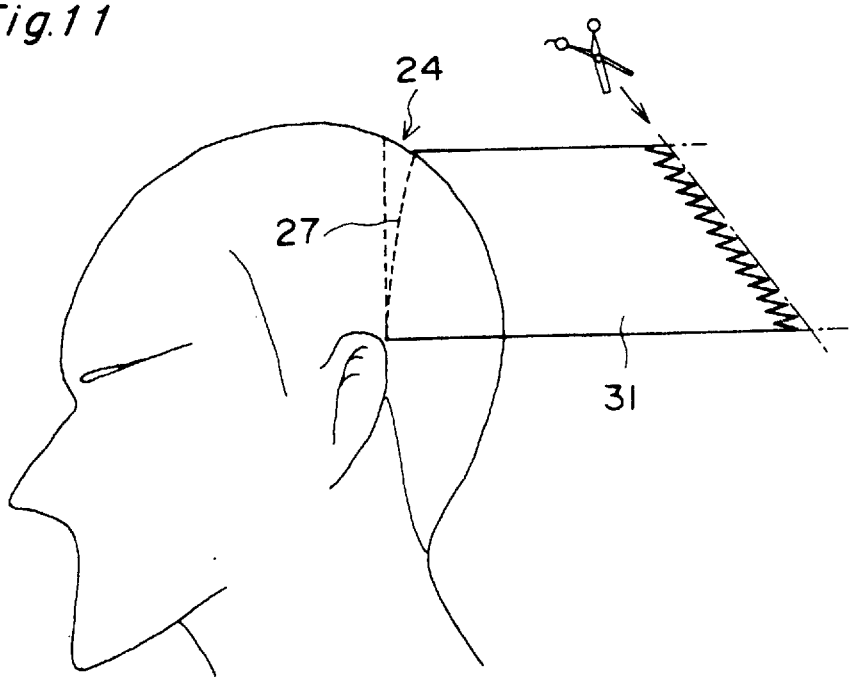
FIG. 11 is an explanatory view showing how to cut the vector portion of the second block in the first embodiment of the haircut method according to the invention.

The cutting of the vector portions 27 and 28 is carried out, as shown in FIG. 11, first by taking a hair bundle 31 in a slicing or combing way out of the corresponding zone along a line extending from the top of the second block 24 to the upper ends of the right and left ears, respectively, and then by cutting the hair bundle 31 so that the hair gets increasingly longer from the top end thereof toward the bottom of the block 24. For this vector portion, 27 and 28, the hair is cut so that its length falls within a range of 70–80% of the guide for the outer.

Figure 12:
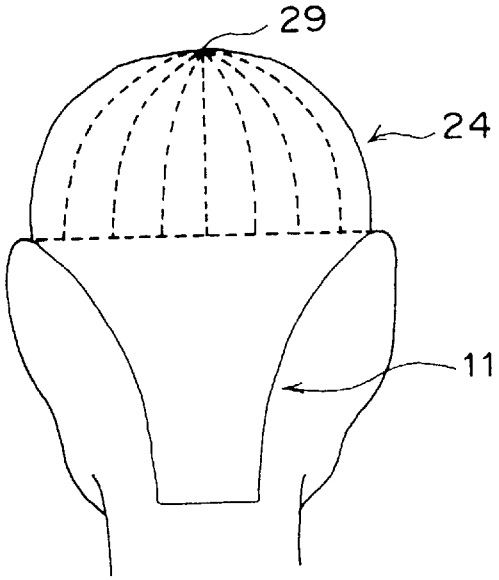
FIG. 12 is an explanatory view showing a pattern as to how to take hair bundles for cutting of an outer portion of hair of the second block in the first embodiment of the haircut method according to the invention.
Figure 13:
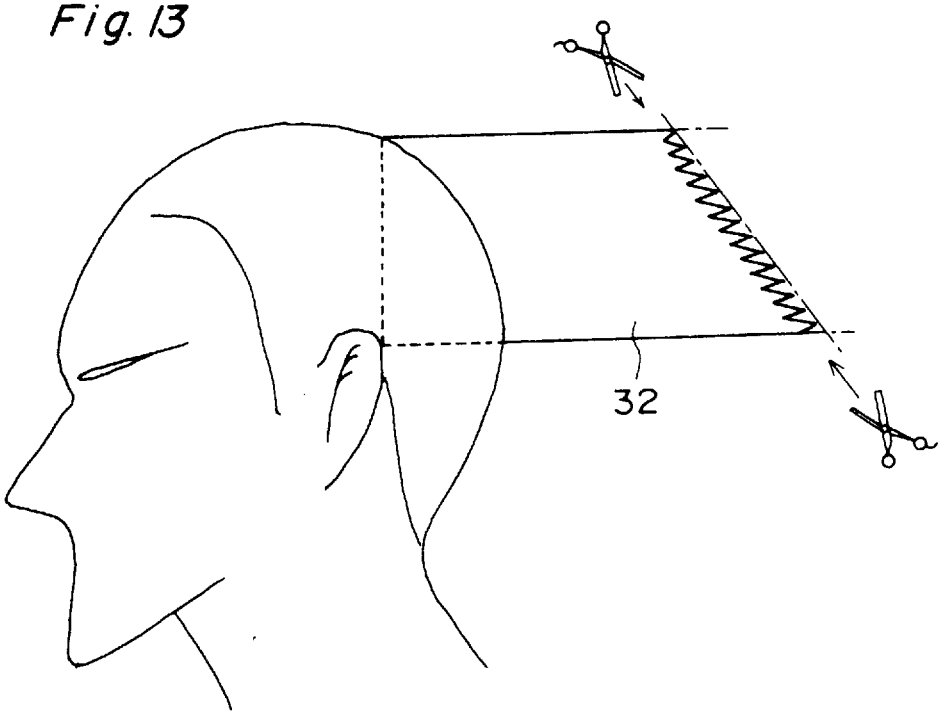
FIG. 13 is an explanatory view showing how to cut the outer portion of the second block in the first embodiment of the haircut method according to the invention.

The outer portion of hair is cut through the steps of, as shown in FIG. 12, first dividing the whole second block 24 into three longitudinal slices for each of right and left halves, and then cutting a hair bundle 32 (shown in FIG. 13) of each slice. Each longitudinal slice is taken radially from the top 29 of the second block 24 as shown in the figure. This cut is done by taking, as its guide, the length of the upper-end hair of the first block 11 that has already been cut, so that the hair gets increasingly shorter toward the top. The direction in which the cut is carried out may be started with either the top side or the bottom side of the block as shown in FIG. 13.

Figure 14:
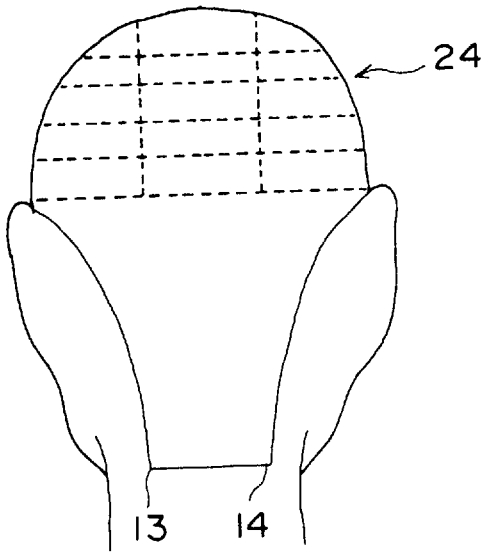
FIG. 14 is an explanatory view showing a pattern as to how to take hair bundles for a check cut of the second block in the first embodiment of the haircut method according to the invention.
Figure 15:
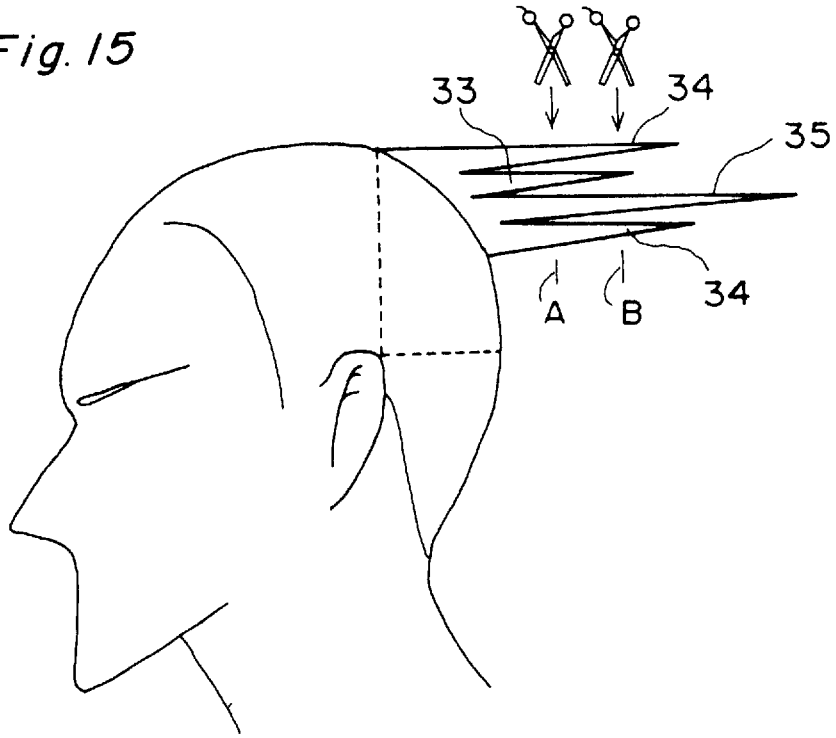
FIG. 15 is an explanatory view showing how to make the check cut of the second block in the first embodiment of the haircut method according to the invention.

The second block 24 is also coiffed by a check cut as a finishing cut. The check cut is carried out through the steps of, as shown in FIG. 14, dividing the whole block 24 into three longitudinal sub-blocks (i.e. a left longitudinal sub-block, a central longitudinal sub-block, and a right longitudinal sub-block) by lines extending straight upward from the nape corners 13 and 14, and taking and cutting horizontal slices from the top down for each of the three blocks. Each slice has the founding hair 33, the vector hair 34 and the outer hair 35 mixed together therein as shown in FIG. 15. A tapering cut is carried out over a range from A to B (which corresponds to the hair-tip portions of the founding hair 33 and the vector hair 34), as shown in the figure, for each slice.

Figure 16:
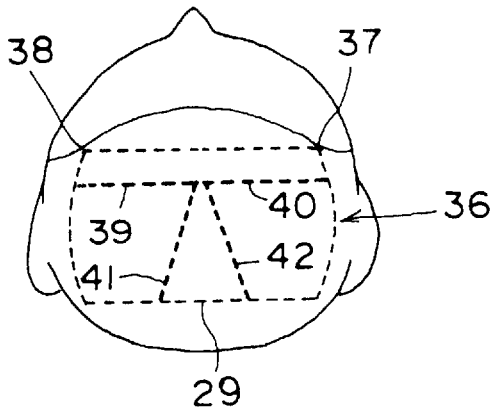
FIG. 16 is an explanatory view showing patterns of founding and vector portions of a third block, as viewed from above the head, in the first embodiment of the haircut method according to the invention.
Figure 17:
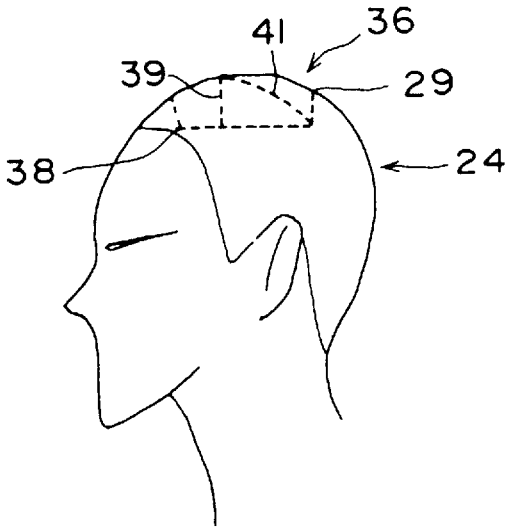
FIG. 17 is an explanatory view showing the patterns of founding and vector portions of the third block, as viewed from the left side of the head, in the first embodiment of the haircut method according to the invention.

Further, the procedure of cutting hair in a third block 36 is explained below. The third block 36 of hair is determined so as not to occupy the forelock portion, and is defined as a block which, as shown in FIGS. 16 and 17, ranges in the back-and-forth direction from the top 29 of the second block 24 through the crown of the head up to a place 2 to 3 cm behind the fore end of the front of the head, and in the right-and-left direction to both face corners 37 and 38, where cut zones for founding portions 39 and 40 and vector portions 41 and 42 are set or determined as shown in the figure. The founding portions 39 and 40 are defined or determined by an extension line from the sideburns (i.e. the extension line is the line extending generally straight upward from the sideburns). The vector portions 41 and 42 are defined by a pair of lines extending from the center of the founding line toward right and left nape corners.

Figure 18:
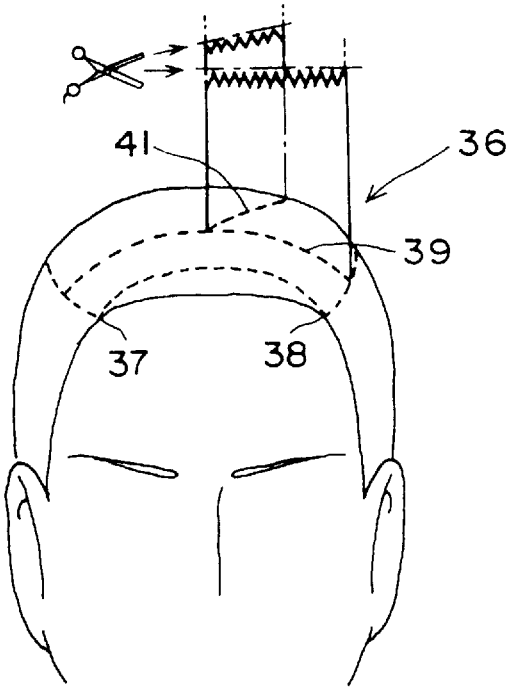
FIG. 18 is an explanatory view showing how to cut the founding and vector portions of the third block in the first embodiment of the haircut method according to the invention.

The founding portions 39 and 40 and the vector portions 41 and 42 are cut, as shown in FIG. 18, through the steps of first taking out slices radially from the center of the founding line, and then cutting the corresponding hair generally parallel with the head skin so that the hair length remain, uniform in length. For the founding portions 39 and 40, the hair is cut so that its length falls within a range of 50–70% of the guide for the outer. For the vector portions 41 and 42, the hair is cut so that its length falls within a range of 70–80% of the guide for the outer.

Figure 19:
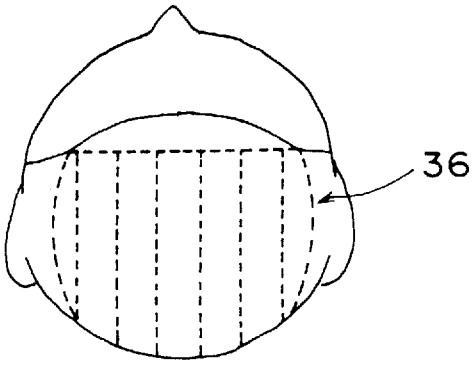
FIG. 19 is an explanatory view showing how to take hair bundles for cutting of an outer portion of hair of the third block in the first embodiment of the haircut method according to the invention.
Figure 20:
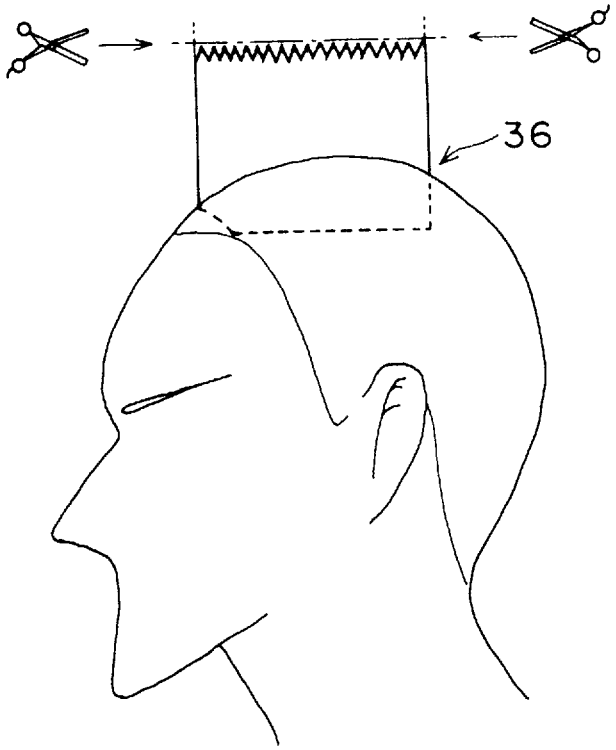
FIG. 20 is an explanatory view showing how to cut the outer portion of the third block in the first embodiment of the haircut method according to the invention.

The outer hair is cut through the steps of, as shown in FIG. 19, first dividing the whole third block 36 into generally equal seven longitudinal slices in the back-and-forth direction of the head, and then cutting the slices in an order starting with the central slice and followed by leftward or rightward slices. This cut is done generally parallel with the head skin, as shown in FIG. 20, so that the hair remains uniform in length. The direction in which the cut is carried out may be started with either the front or the rear. The length of the guide for the outer is determined as the length of the outer hair that has already been cut in the second block 24 at the boundary between the second block 24 and the third block 36.

Figure 21:
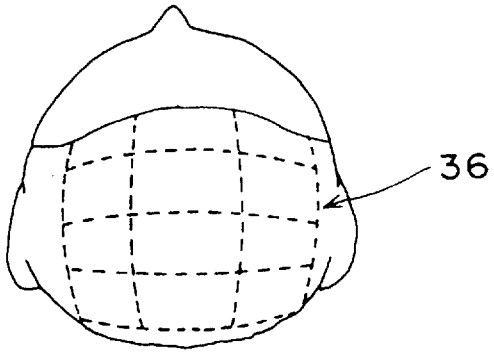
FIG. 21 is an explanatory view showing a pattern as to how to take hair bundles for a check cut of the third block in the first embodiment of the haircut method according to the invention.
Figure 22:
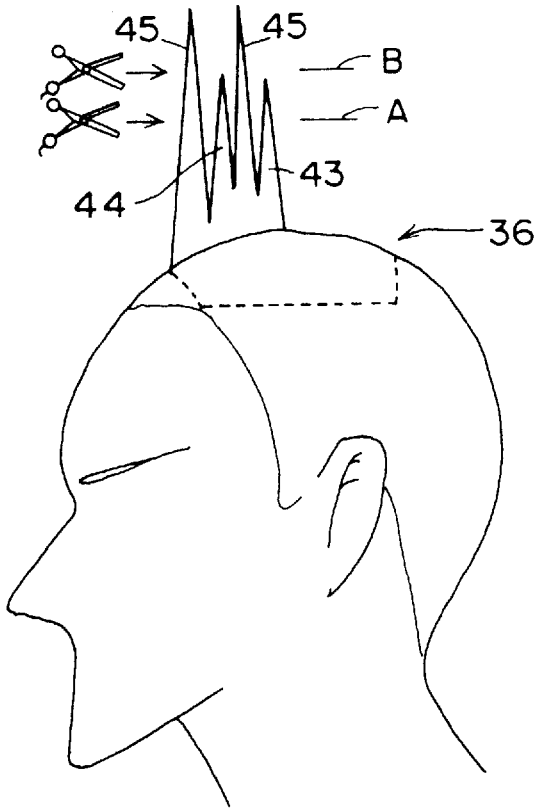
FIG. 22 is an explanatory view showing how to make the check cut of the third block in the first embodiment of the haircut method according to the invention.

The check cut for the third block 36 is carried out through the steps of, as shown in FIG. 21, first dividing the whole block 36 into three longitudinal sub-blocks (i.e. a left longitudinal sub-block, a central longitudinal sub-block, and a right longitudinal sub-block), and then taking and cutting horizontal slices from the front to the rear for each of the three blocks. Each slice has the founding hair 43, the vector hair 44 and the outer hair 45 mixed together therein as shown in FIG. 22. A tapering cut is carried out over a range from A to B (which corresponds to the hair-tip portions of the founding hair 43 and the vector hair 44), as shown in the figure, for each slice.

Figure 23:
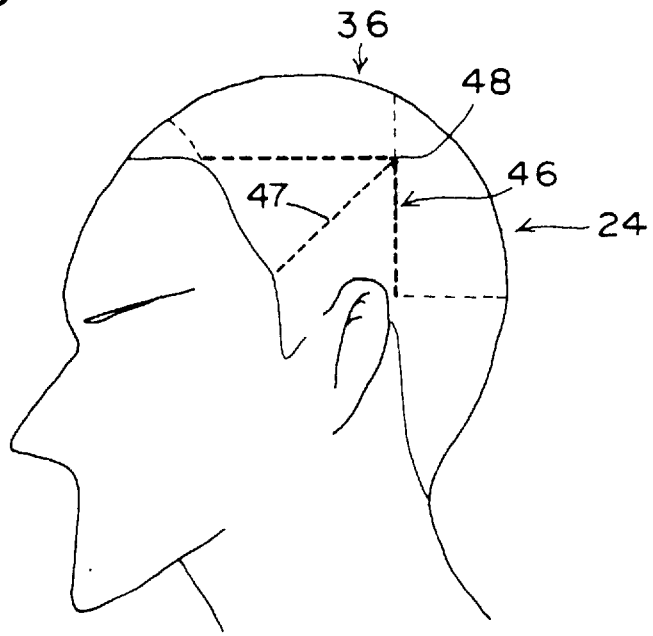
FIG. 23 is an explanatory view showing a pattern of a vector portion of hair of a fourth block, as viewed from the left side of the head, in the first embodiment of the haircut method according to the invention.

The procedure of cutting hair in a fourth block 46 is explained below. The fourth block 46, as shown in FIG. 23, corresponds to both side parts of the head, which are surrounded by the second block 24 and the third block 36, respectively. For this fourth block 46, there is not allotted a founding portion: only a vector portion 47 is allotted and the hair thereof is cut. The vector portion 47 is defined or determined by a line extending from a point of intersection 80 of the second block 24 and the third block 36 toward a tail of an eye.

Figure 24:
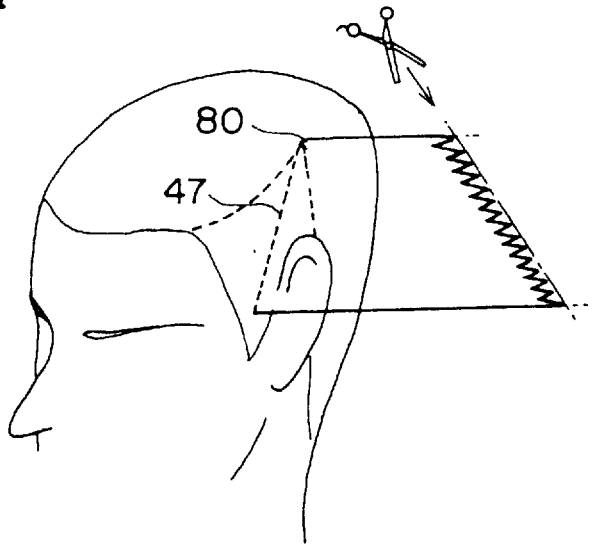
FIG. 24 is an explanatory view showing how to cut the vector portion of the fourth block in the first embodiment of the haircut method according to the invention.

The hair of the vector portion 47 is cut, as shown in FIG. 24, so that the hair gets increasingly longer along a direction from the point of intersection 80 toward the tail of the eye. For this vector portion 47, the hair is cut so that its length falls within a range of 70–80% of the guide for the outer.

Figure 25:
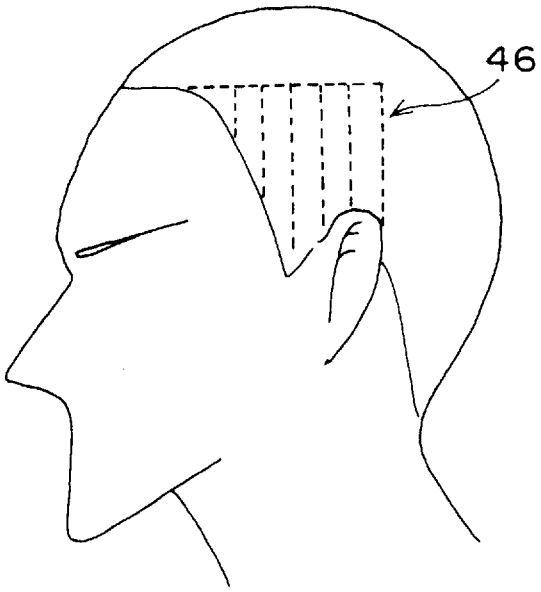
FIG. 25 is an explanatory view showing a pattern as to how to take hair bundles for cutting of an outer portion of hair of the fourth block in the first embodiment of the haircut method according to the invention.
Figure 26:
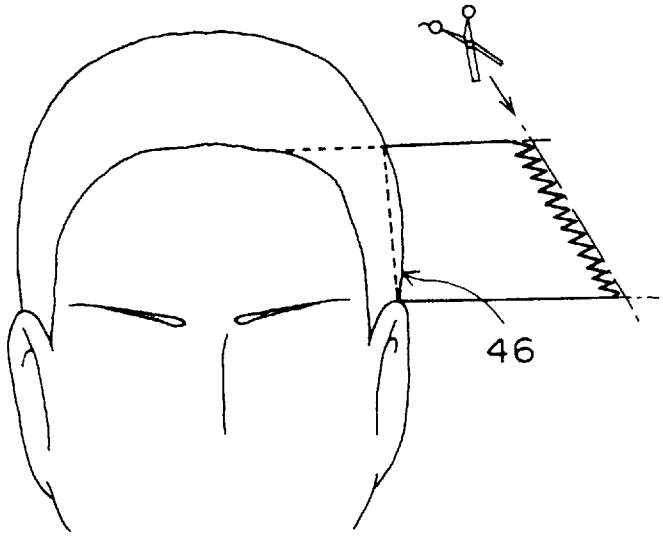
FIG. 26 is an explanatory view showing how to cut the outer portion of the fourth block in the first embodiment of the haircut method according to the invention.

The outer hair is cut through the steps of, as shown in FIG. 25, first dividing the whole fourth block 46 into generally equal five longitudinal slices, and then cutting hair of the slices from behind the ear to the front. The length of the guide for the outer is determined as the length of the outer hair that has already been cut in the second block 24 at the boundary between the second block 24 and the fourth block 46, and the cut is carried out so that the hair gets increasingly longer from top down of the fourth block 46, as shown in FIG. 26.

Figure 27:
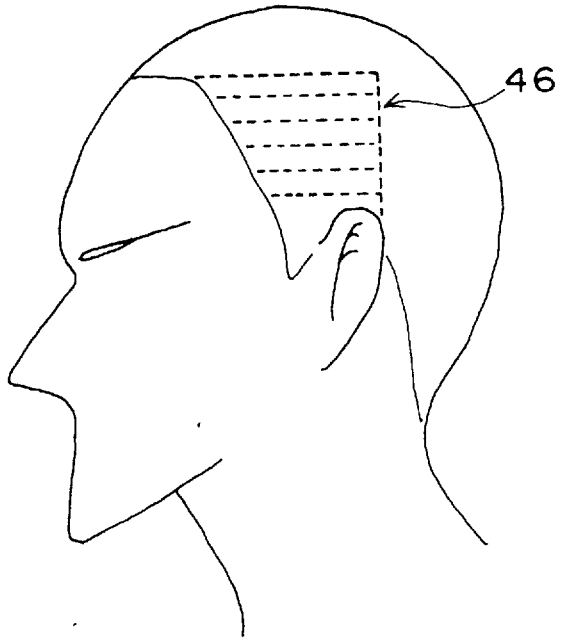
FIG. 27 is an explanatory view showing a pattern as to how to take hair bundles for a check cut of the fourth block in the first embodiment of the haircut method according to the invention.

The check cut is carried out by taking horizontal slices and making a tapering cut on each slice sequentially, starting with the top of the fourth block 46, as shown in FIG. 27.

Figure 28:
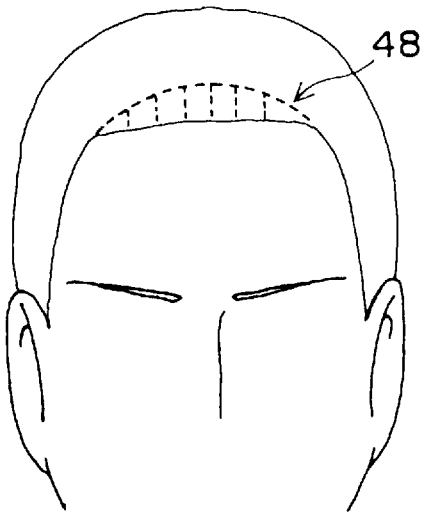
FIG. 28 is an explanatory view showing a fifth block in the first embodiment of the haircut method according to the invention.

Finally, the cut of the forelock zone as a fifth block 48 with 2 to 3 cm width from the front of the third block 36 ahead is described below, with reference to FIG. 28. This block 48 is a part which is fundamentally different in style from that of the other parts, as a hairstyle. More specifically, the hairstyle of this block has importance in connection with the makeup of the face, allowing a wide range of variations as part of the makeup. Here is explained a cut as an example of such variations.

Figure 29:
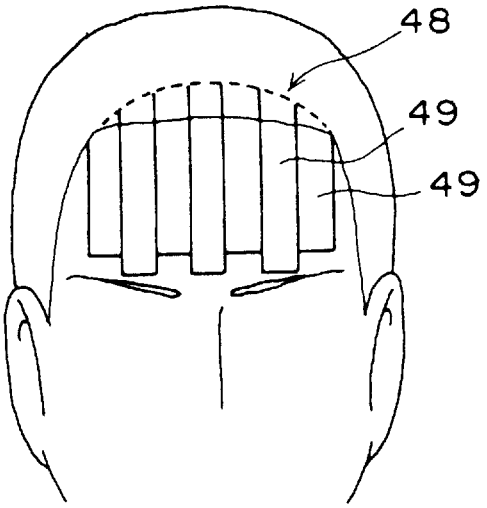
FIG. 29 is an explanatory view showing how to take hair bundles for cutting of a forelock of hair, in connection with a way of how to take an outline thereof, of the fifth block in the first embodiment of the haircut method according to the invention.

As shown in FIG. 29, hair bundles 49 are set up by dividing the block 48 into equal seven sub-blocks in a horizontal direction, and the hair is cut so that the hair bundles 49 get alternately long and short in length. Finally, an outline thereof is determined, and the hair is cut.

In the hairstyle with hair cut up and coiffed through the above steps, each block has the founding hair, the vector hair, and the outer hair mixed together therein in accordance with preconsidered patterns, allowing the resulting hairstyle thus finished to such a hairstyle in which the outer hair naturally and lightly moves on the founding and vector hair. This hairstyle maintains a constantly balanced natural appearance no matter how the person moves. This eliminates the need to care for any disturbance of hairstyle, the problem of which is involved in conventional hairstyles at time of wind blowing or playing sport games.

Figure 30:
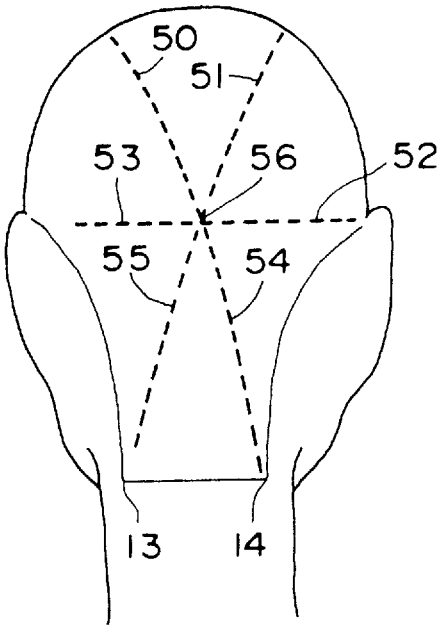
FIG. 30 is an explanatory view showing patterns of founding and vector portions, as viewed from a rear side of the head, in a second embodiment of the haircut method according to the present invention.
Figure 31:
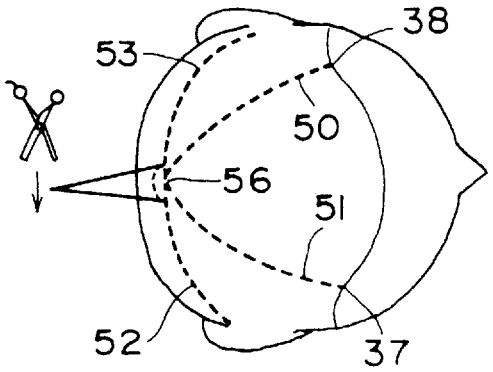
FIG. 31 is an explanatory view showing the patterns of founding and vector portions, as viewed from above the head, in the second embodiment of the haircut method according to the invention.
Figure 32:
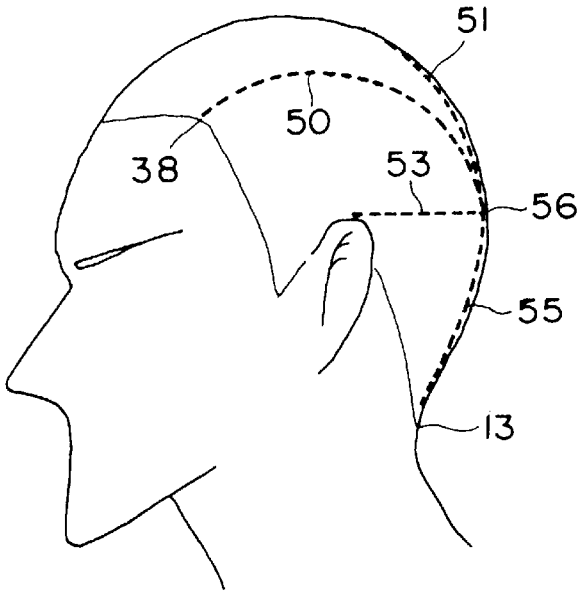
FIG. 32 is an explanatory view showing the patterns of founding and vector portions, as viewed from left side of the head, in the second embodiment of the haircut method according to the invention.

Next, a cutting for a medium hairstyle as a second embodiment is briefly explained below. In this cutting, as shown in FIGS. 30, 31 and 32, founding portions 50 and 51, and vector portions 52, 53, 54 and 55 are set or determined as shown in the figures over the entire region where the hair is grown. These portions are defined by lines extending from the two face corners 37 and 38 and intersecting at a center point 56 of the back part of the head and reaching the nape corners 13 and 14, and defined by a line passing through the center point 56 of the intersection and horizontally connecting the upper ends of the two ears with each other on the back side of the head. However, in this example, 2–3 cm margins which are not used as vector portions 53 and 55 are left for both end portions of the lines that extend from the point 56 of intersection to the left ear and to the left nape corner 13, respectively. Except these margins, the founding portions 50 and 51, and the vector portions 52 and 53, and 54 and 55 are, respectively symmetrical relative to a vertical line passing through the point 56 of intersection in FIG. 30.

Out of these lines, the founding portions 50 and 51 are defined as a portion extending from both face corners 37 and 38 up to the point 56 of intersection in the center of the back part of the head (the point 56 of intersection is also included in the founding portion 50 and 51), while the remaining portions are the vector portions 52, 53, 54 and 55.

Figure 33:
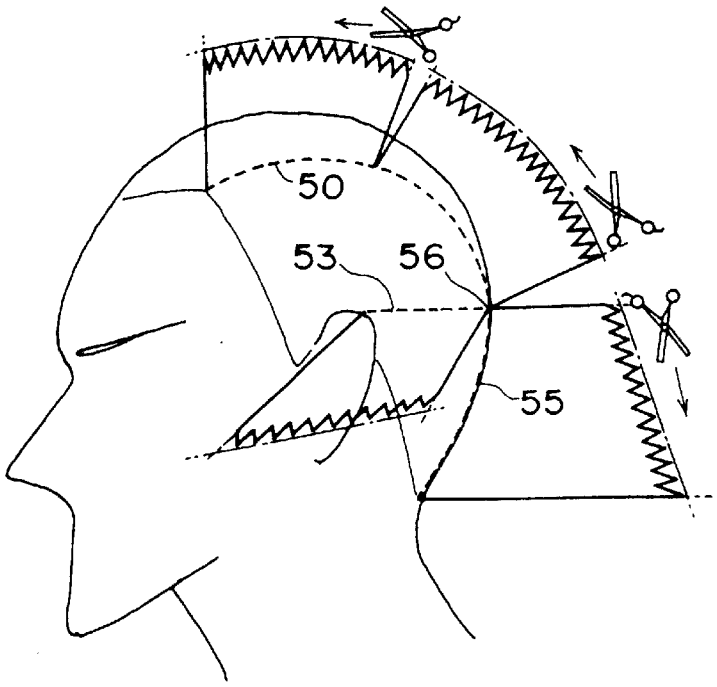
FIG. 33 is an explanatory view showing how to cut the founding and vector portions in the second embodiment of the haircut method according to the invention.

FIG. 33 shows how to cut the right-and-left symmetrical founding and vector portions 50, 51, 52, 53, 54 and 55. The cutting is started with the point 56 of intersection. The hair length determined at the point 56 is used as a guide for the founding portions 50 and 51 to be cut subsequently. That is, the vector portions 52 and 53 of the horizontal line are first cut from the point 56 of intersection; then, the founding portion is cut from the point of intersection 56 toward both face corners 37 and 38; and the founding portion is cut from the point 56 of intersection to both nape corners 13 and 14. Each portion is first taken vertically relative to the head skin in a slicing or combing manner, and then cut so that the length of hair of the vector portions 52 and 53 increases from the point 56 of intersection towards the upper end of each ear up to about 80% of the outer guide, with a length 70% of the outer guide as a length for the vector guide. The founding portions 50 and 51 extending from the point 56 of intersection to both face corners 37 and 38 are cut with a length 50% of the guide for the outer as a guide for the founding portions 50 and 51 so that the hair remains generally constant in length.

The vector portions 54 and 55, which extend from the point 56 of intersection to both nape corners 13 and 14, are cut with a length 70% of the guide for the outer as a guide for the vector portions 54 and 55 so that the hair gets increasingly longer (up to about 80% of the guide for the outer) from the point 56 of intersection toward the nape corners 13 and 14. The guide for the outer is determined depending on the length for the medium hair that the client desires.

Figure 34:
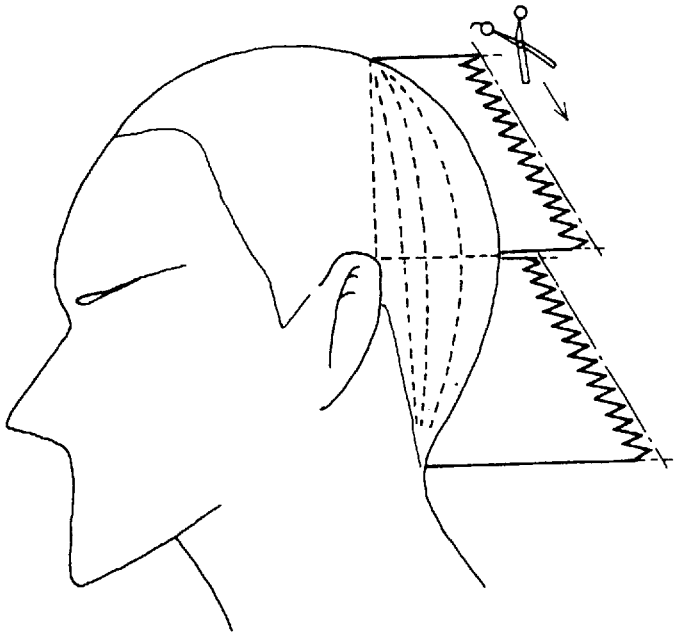
FIG. 34 is an explanatory view showing how to cut an outer portion of hair of a head-back-part block in the second embodiment of the haircut method according to the invention.
Figure 35:
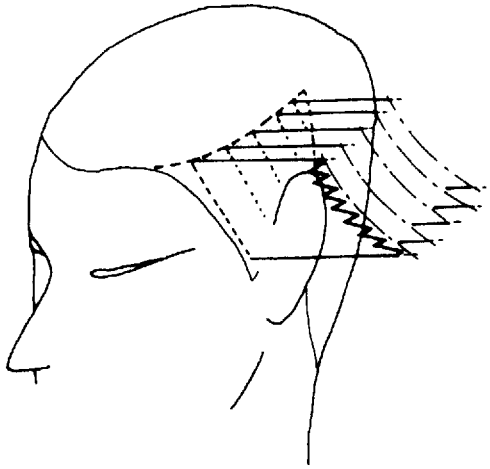
FIG. 35 is an explanatory view showing how to cut the outer portion of the head-side-part block in the second embodiment of the haircut method according to the invention.

For the cutting of the outer, longitudinal slices are taken for each of the same blocks as the first and second blocks which are head-back-part blocks in the first embodiment, and the slices are cut so that the hair gets increasingly longer from top down, as shown in FIG. 34. Also, longitudinal slices are taken for the same block as the fourth block which is the head-side-part block in the first embodiment, and the slices are cut so that the hair gets increasingly longer from top down, as shown in FIG. 35.

Figure 36:
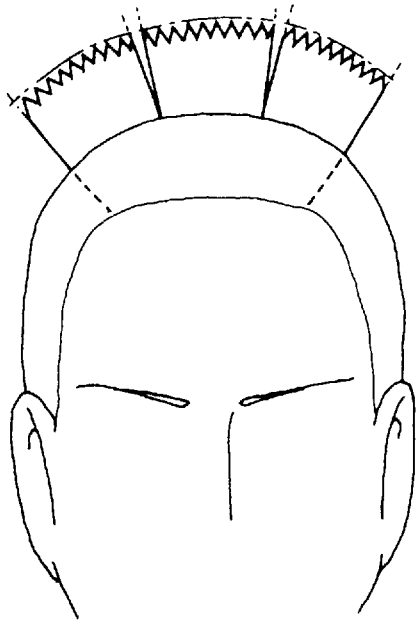
FIG. 36 is an explanatory view showing how to cut the outer portion of hair of head-top-part and head-front-part blocks in the second embodiment of the haircut method according to the invention.

Further, lateral slices of hair bundles are taken for the same blocks as the third and fifth blocks which are the head-top-part and head-front-part blocks in the first embodiment, as shown in FIG. 36, and the slices are cut so that the hair gets generally uniform in length, by which an outline of hairstyle is made.

Finally, each of the blocks is finished by making a check cut. For the check cut, each slice has the founding hair, the vector hair and the outer hair mixed together therein, as in the first embodiment, and a tapering cut is carried out over a range of hair-tip side portions of the founding hair and vector hair for each of the slices.

Next, a cutting for a short hairstyle as a third embodiment is briefly explained.

Figure 37:
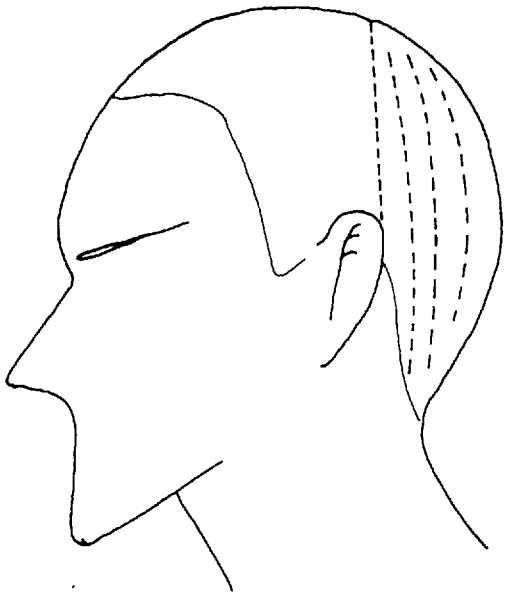
FIG. 37 is an explanatory view showing a pattern as to how to take hair bundles for cutting of an outer portion of hair of a head-back-part block in a third embodiment of the haircut method according to the present invention.
Figure 38:
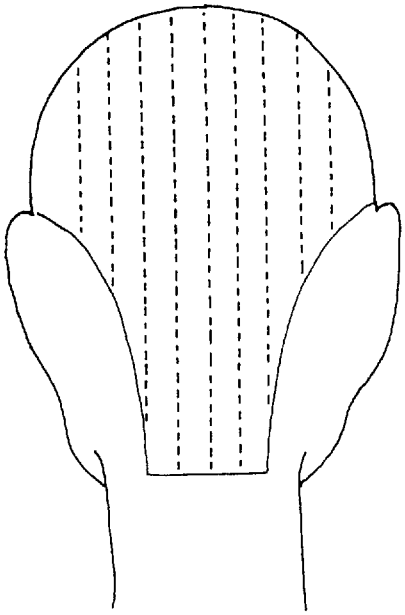
FIG. 38 is an explanatory view showing the pattern as to how to take hair bundles for cutting of the outer portion of the head-back-part block in the third embodiment of the haircut method according to the invention.
Figure 39:
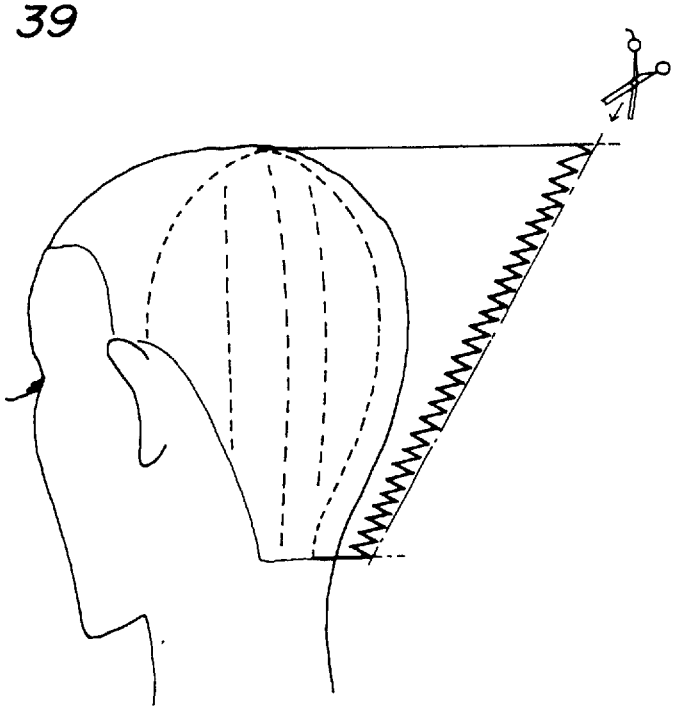
FIG. 39 is an explanatory view showing how to cut the outer portion of the head-back-part block in the third embodiment of the haircut method according to the invention.

This cut is first started with the outer hair. For each of the same blocks as the first and second blocks which are head-back-part blocks in the first embodiment, longitudinal slices of hair bundles are taken in a slicing manner in parallel with one another as shown in FIGS. 37 and 38, and then the slices are cut so that the hair gets increasingly shorter from top down in each block, as shown in FIG. 39. The cut angle for this cut is determined by taking into account the configuration as to whether the back part of the head is flat or roundly protruded, or other conditions. The cut angle is approximately 45° on the average. The guide for the outer is determined depending on the length for the short-hair coiffure that the client desires.

Figure 40:
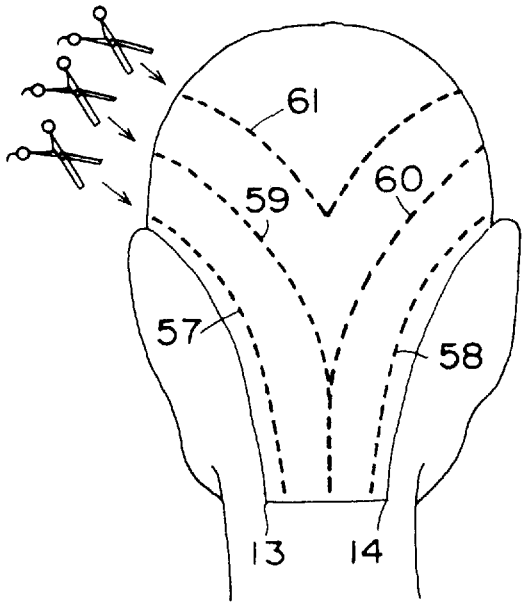
FIG. 40 is an explanatory view showing patterns of founding and vector portions of the head-back-part block, as viewed from a rear side of the head, in the third embodiment of the haircut method according to the invention.

After the cut of the outer hair the founding and vector portions of hair are cut. As shown in FIG. 40, first founding portions 57 and 58 are set or determined along hairlines extending from above the two ears of the head-back-part block to the nape corners 13 and 14, and second founding portions 59 and 60 are set or determined between the first founding portions 57 and 58 in parallel with the first founding portions 57 and 58. The second founding portions 59 and 60 are so set as to join together at the nape portions, forming a generally Y shape. Further, above the second founding portions 59 and 60, a generally V-shaped vector portion 61 is set so as to be parallel with the second founding portions 59 and 60. A portion between the first founding portions 57, 58 and the second founding portions 59, 60, and another portion between the second founding portions 59, 60 and the vector portion 61, are left as outer portions, respectively. The founding and vector portions are cut by taking slices of hair bundles in a direction from both sides toward the center along the lines. The first founding portions 57 and 58 are cut to a length around 10% of the guide for the outer portion so that the bottom or skirt of the hair is lightened as much as possible. As a result, the hair tips of the outer portion, which come over the bottom or skirt portion thereof, have a maximum movability.

The second founding portions 59 and 60 are cut to a length around 50–70% of the guide for the outer. Also, the vector portion 61 is cut to a length around 70–90% thereof.

Figure 41:
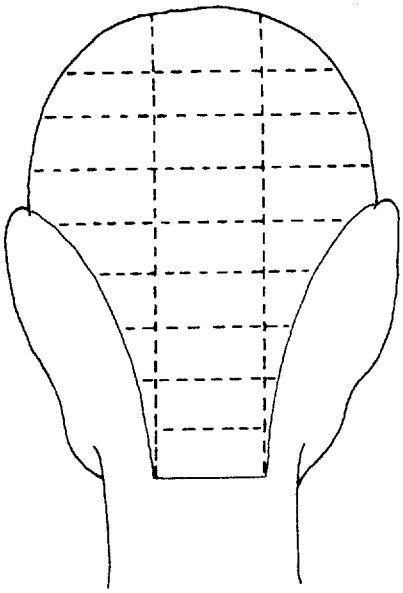
FIG. 41 is an explanatory view showing how to take hair bundles for a check cut of the head-back-part block in the third embodiment of the haircut method according to the invention.
Figure 42:
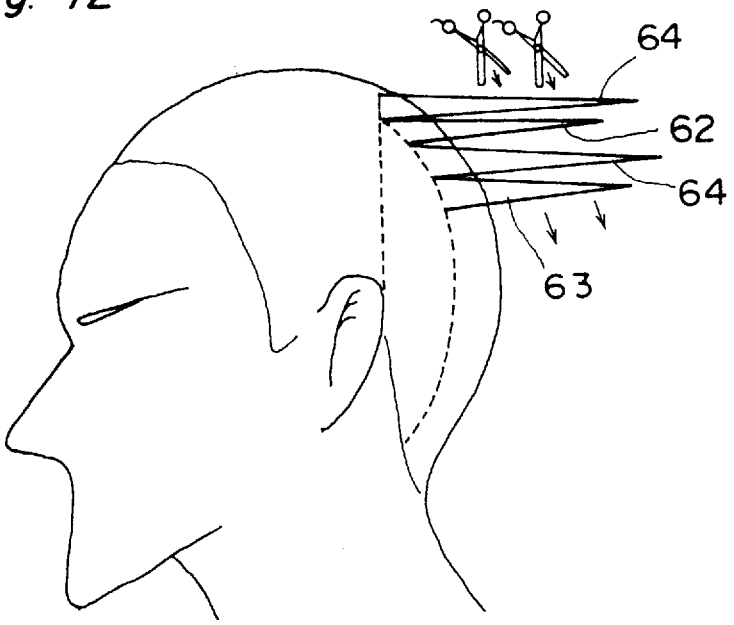
FIG. 42 is an explanatory view showing how to make a check cut of the head-back-part block in the third embodiment of the haircut method according to the invention.

The check cut for the head-back-part block is carried out through the steps of, as shown in FIG. 41, first dividing the whole block into three longitudinal blocks (i.e. a left longitudinal block, a central longitudinal block, and a right longitudinal block) and then taking lateral slices horizontally and then cutting them from the top down for each of the three blocks. Each slice has the founding hair 62, the vector hair 63 and the outer hair 64 mixed together therein as shown in FIG. 42, and a tapering cut is carried out within a range in which the hair-tip side portions of the founding hair and the vector hair are included for each slice.

Next, a cut for a head-side-part block, which corresponds to the fourth block of the first embodiment, is explained below.

Figure 43:
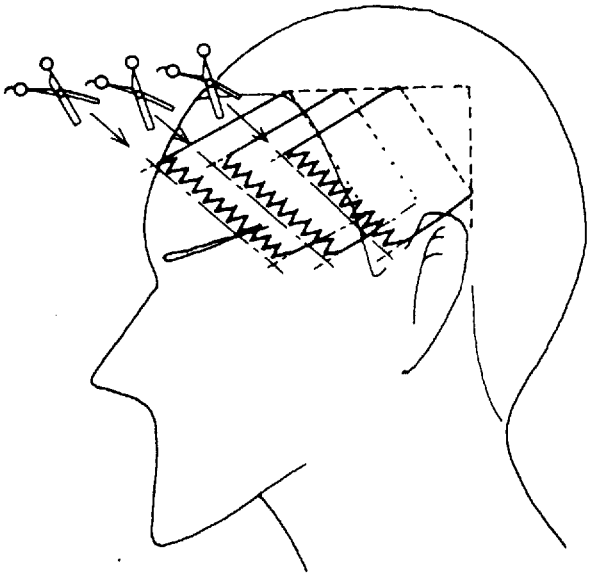
FIG. 43 is an explanatory view showing how to cut the outer portion of a head-side-part block in the third embodiment of the haircut method according to the invention.

This cut for the block is also started with the outer hair. As shown in FIG. 43, oblique slices extending or orientating from its front top to its rear bottom are taken up by turns from the rear side, and each of the oblique slices is cut by pulling them somewhat to the front. The guide for the outer is set or determined as the length of the outer hair that has already been cut at the boundary of the adjacent head-back-part block, and the cut is carried out so that the hair gets increasingly a bit shorter from top down.

Figure 44:
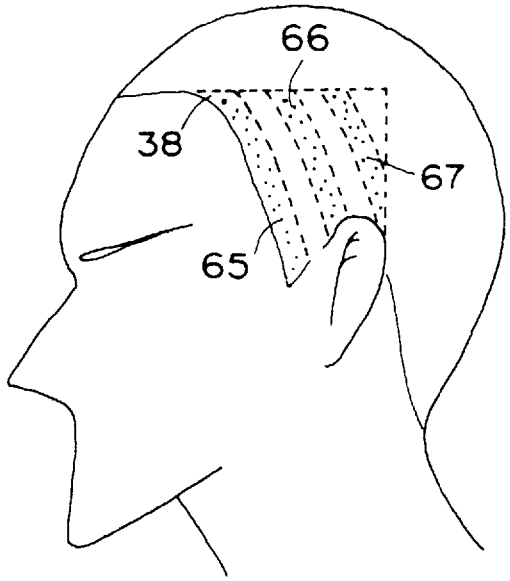
FIG. 44 is an explanatory view showing patterns of founding and vector portions of the head-side-part block, as viewed from a left side of the head, in the third embodiment of the haircut method according to the invention.

After the cut of the outer is accomplished, the founding and vector portions are cut. As shown in FIG. 44, a first founding portion 65 is set along a hairline extending from the face corner 38 to the temple, and a second founding portion 66 is set behind the first founding portion 65 in parallel with the first founding portion. The second founding portion 66 leads to an upper end portion of the root of the ear.

Further, behind the second founding portion 66, a vector portion 67 is set so as to be parallel with the second founding portion 66. A portion between the first founding portion 65 and the second founding portion 66, another portion between the second founding portion 66 and the vector portion 67, and further a back-side portion obliquely above the vector portion 67, are all left as the outer portion, respectively.

The founding and vector portions are cut by taking slices of hair bundles along the line. The first founding portion 65 is cut to a length around 10% of the guide for the outer portion so that the hairline is lightened as much as possible. As a result, the hair tips of the outer, which come over around the hairline, have a maximum movability.

The second founding portion 66 is cut to a length around 50–70% of the guide for the outers. Also, the vector portion 67 is cut to a length around 70–90% thereof.

Also for this block, the check cut is done by a tapering cut within a range in which the hair-tip side portions of the founding hair and vector hair are included, like the other blocks.

Next, the cut for the block ranging from top to front of the head is explained below.

Figure 45:
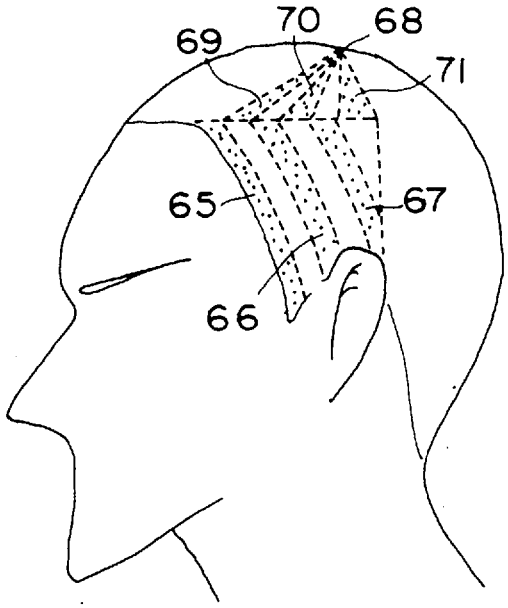
FIG. 45 is an explanatory view showing the pattern of the vector portion of a head-top-part block, as viewed from the left side of the head, in the third embodiment of the haircut method according to the invention.
Figure 46:
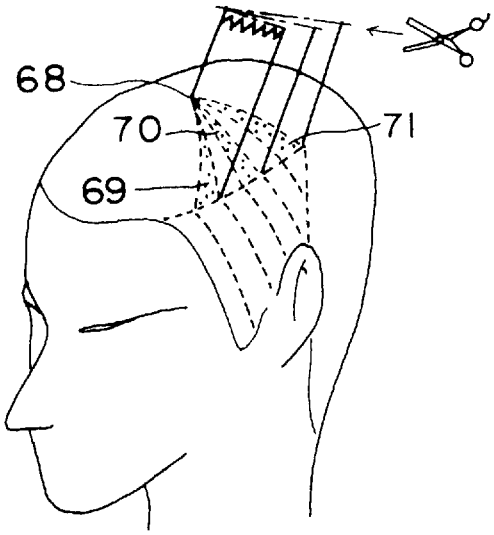
FIG. 46 is an explanatory view showing how to cut the vector portion of the head-top-part block in the third embodiment of the haircut method according to the invention.

For this block, vector portions 69, 70 and 71 are set radially from a center 68 of the head top toward both side portions of the head as shown in FIG. 45. These vector portions 69, 70 and 71 are connected to the portions that have been left as outer portions between the first founding portion 65 and the second founding portion 66, and between the second founding portion 66 and the vector portion 67 on both side-part blocks of the head. That is, the founding and vector portions 65, 66 and 67 on the side portions of the head do not extend to the vector portions 69, 70 and 71 on the top portion of the head, by which variations in pattern are added. The cut for the vector portions 69, 70 and 71 is carried out by taking slices of hair bundles along the lines thereof and by cutting the slices thereof so that the hair gets increasingly shorter toward the center 68 of the head as shown in FIG. 46.

The guide for the vector portions 69, 70 and 71 is set to a length around 70% of the guide for the outer portion.

Figure 47:
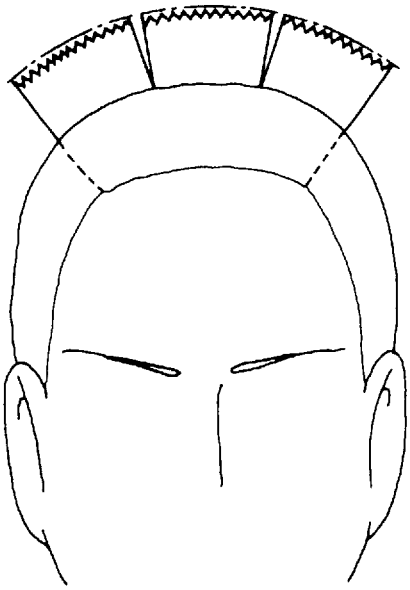
FIG. 47 is an explanatory view showing how to cut the outer portion of the head-top-part block and a head- front-part blocks in the third embodiment of the haircut method according to the invention.

After the vector portions 69, 70 and 71 are cut, the outer portions are cut in such a way that hair bundles are taken as lateral slices and that the lateral slices are cut with a generally uniform length, as shown in FIG. 47, in order to make an outline of hairstyle.

Finally, all the blocks are finished by using a check cut. For the check cut, each slice has the founding hair, the vector hair and the outer hair mixed together therein as in the first and second embodiments, and a tapering cut is carried out within a range in which the hair-tip side portions of the founding hair and the vector hair are included for each slice.

In the above embodiments, a combination of three different types of cuttings with three different guides, which are the founding, vector and outer guides, is used. Alternatively, it is possible to use a combination of a cutting with a middle reference length between the founding and the vector, and a cutting for the outer.

Alternatively, it is also possible to combine four or more kinds of cutting with four or more different guides.

According to the haircut method of the present invention, hair of the founding portion, hair of the vector portion, and hair of the outer portion are mixed together in each block in balanced patterns, allowing the resulting hairstyle to be finished to one having natural irregularities. With these hairstyles, the outer hair moves and flaps over the founding and vector portions of hair lightly, beautifully and naturally. The hairstyle thus coiffed maintains a constantly balanced natural appearance or look, no matter what kinds of motions may be made. This eliminates the need to care for any disorder of hairstyle, the problem of which arises in respect of conventional hairstyles at time of wind blowing and/or playing sport games. Also, whichever the hairstyle may be: a long hairstyle, a medium hairstyle or a short hairstyle, various nuances of the outer hair can be realized by changing the patterns of the founding and vector portions, beneath the outer hair, which are combined with each other, in various ways.

Although the present invention has been fully described by way of preferred embodiments with reference to the accompanying drawings, it is to be noted that various changes and modifications will be apparent to those skilled in the art. Therefore, unless otherwise such changes and modifications depart from the scope of the present invention as defined by the appended claims, they should be construed as included therein.

What is claimed is:

1. A haircut method in which hair is cut on a basis of at least three different reference lengths, comprising:

a first step of cutting hair on a first partial zone of one's head on a basis of a first reference length which is shortest;

a second step of cutting hair on a second partial zone of the head on a basis of a second reference length which is longer that the first reference length; and a third step of cutting hair on a whole zone of the head, across the first and second partial zones, on a basis of a third reference length which is longer than the second reference length, wherein at the first step the hair is cut so that there remains a first amount of hair which is a largest amount after cutting the hair through the first, second and third steps, wherein at the second step the hair is cut so that there remains a second amount of hair which is smaller than the first amount thereof, wherein at the third step the hair is cut so that there remains a third amount of hair which is smaller than the second amount thereof.

2. The method of claim 1, wherein the second step is taken after the first step, and the third step is taken after the second step.

* * * * *